US005752500A

United States Patent [19]

Jamieson et al.

[11] Patent Number: 5,752,500

[45] Date of Patent: May 19, 1998

[54] DRAFT HOOD LOCATING DEVICE FOR COMBUSTION APPARATUS

[75] Inventors: Donald Reginald Jamieson, Oakville; Susan Leslie Birtch, Mississauga, both of Canada

[73] Assignee: Lennox Industries Inc., Iowa

[21] Appl. No.: 742,933

[22] Filed: Nov. 1, 1996

[51] Int. Cl.[6] ..... F23C 3/00; F23J 13/00

[52] U.S. Cl. ..... 126/512; 126/307 R; 126/315; 126/531

[58] Field of Search ..... 126/512, 77, 531, 126/500, 515, 193, 522, 523, 315, 527, 83, 85, 307 R, 307 A, 317

[56] References Cited

U.S. PATENT DOCUMENTS

| | | | |
|---|---|---|---|
| 2,211 | 8/1841 | Davis . | |
| 280,880 | 7/1883 | Sweetser . | |
| 709,220 | 9/1902 | Houlihan . | |
| 831,429 | 9/1906 | Harrington . | |
| 836,590 | 11/1906 | Le Sauvage . | |
| 975,703 | 11/1910 | McDonald . | |
| 1,278,895 | 9/1918 | Farley . | |
| 1,516,169 | 11/1924 | Wilkinson et al. . | |
| 1,695,645 | 12/1928 | Farley . | |
| 4,460,329 | 7/1984 | Trent | 431/20 |
| 4,653,467 | 3/1987 | Farrell | 126/126 |
| 4,752,210 | 6/1988 | Trent | 431/20 |
| 4,924,850 | 5/1990 | Rieger | 126/500 |
| 5,039,006 | 8/1991 | Habegger | 236/11 |
| 5,299,558 | 4/1994 | Binzer | 126/512 |
| 5,303,693 | 4/1994 | Schroeter et al. | 126/512 X |
| 5,377,666 | 1/1995 | Whitehouse | 126/500 |
| 5,419,307 | 5/1995 | Linkletter et al. | 126/307 |
| 5,575,274 | 11/1996 | DePalma | 126/512 |
| 5,647,340 | 7/1997 | Shimek et al. | 126/512 X |
| 5,647,342 | 7/1997 | Jamieson et al. | 126/512 |

FOREIGN PATENT DOCUMENTS

| | | | |
|---|---|---|---|
| 2082791 | 11/1992 | Canada | F24B 1/18 |
| 2150962 | 6/1995 | Canada | F24C 15/30 |
| 3427744 | 2/1985 | Germany | 126/531 |

*Primary Examiner*—Larry Jones
*Attorney, Agent, or Firm*—W. Kirk McCord

[57] ABSTRACT

A draft hood is provided for mating alignment with a fireplace assembly. The mating alignment is facilitated by the location of alignment hardware fixed to the rear surface of the fireplace and to the inside of the draft hood. In use the hardware permits alignment of the draft hood in a fireplace enclosure without the need to see the fitting, without the need for a long run-in slide, and without the need vertically to pivot the draft hood on installation or to pull the flue termination forward of the firebox flue before attachment. For this purpose an updraft detection warning spill tube may also function as one of the alignment fittings since it is, due to its function, located near or at the junction of the draft hood and fireplace.

22 Claims, 4 Drawing Sheets

Figure 3a.
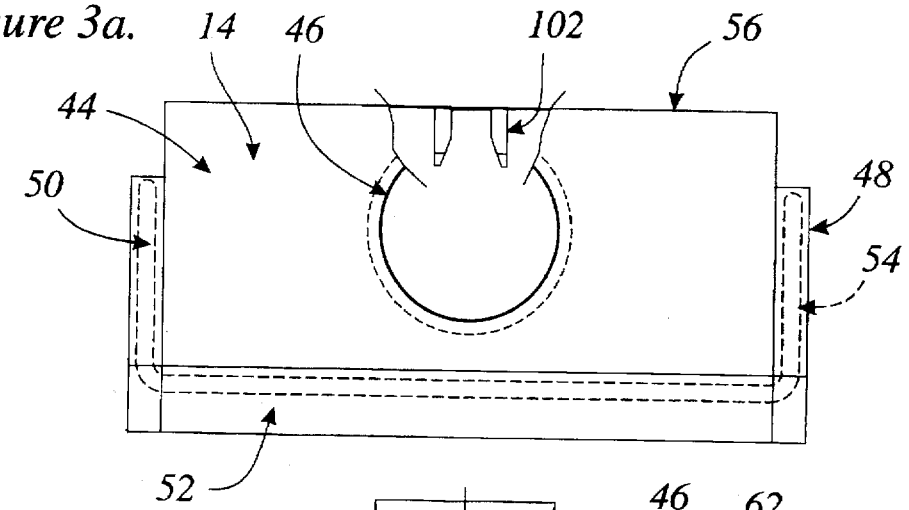
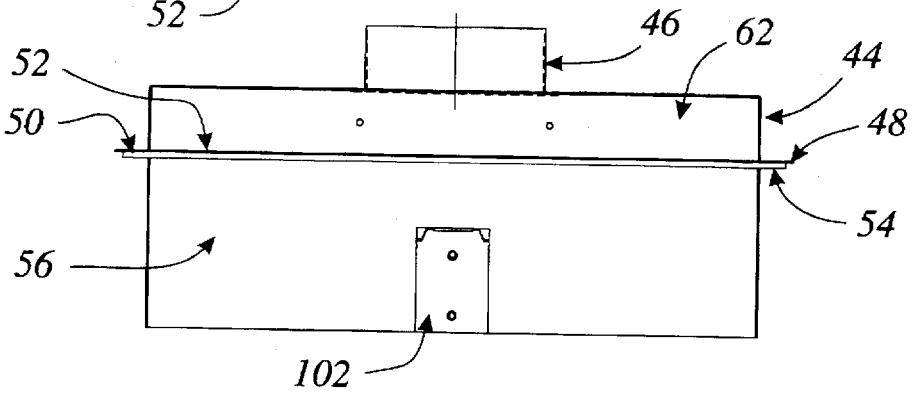
Figure 3b.
Figure 4d.
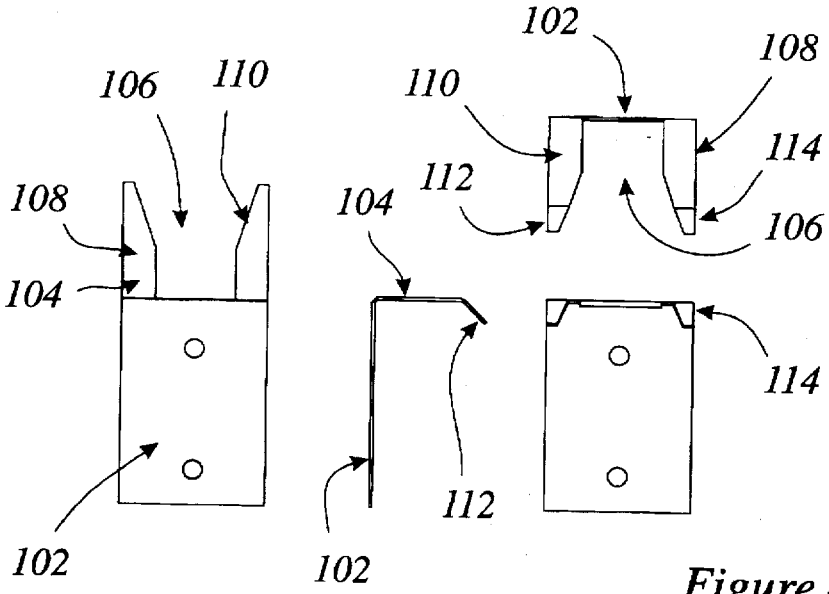
Figure 4a. Figure 4b. Figure 4c.

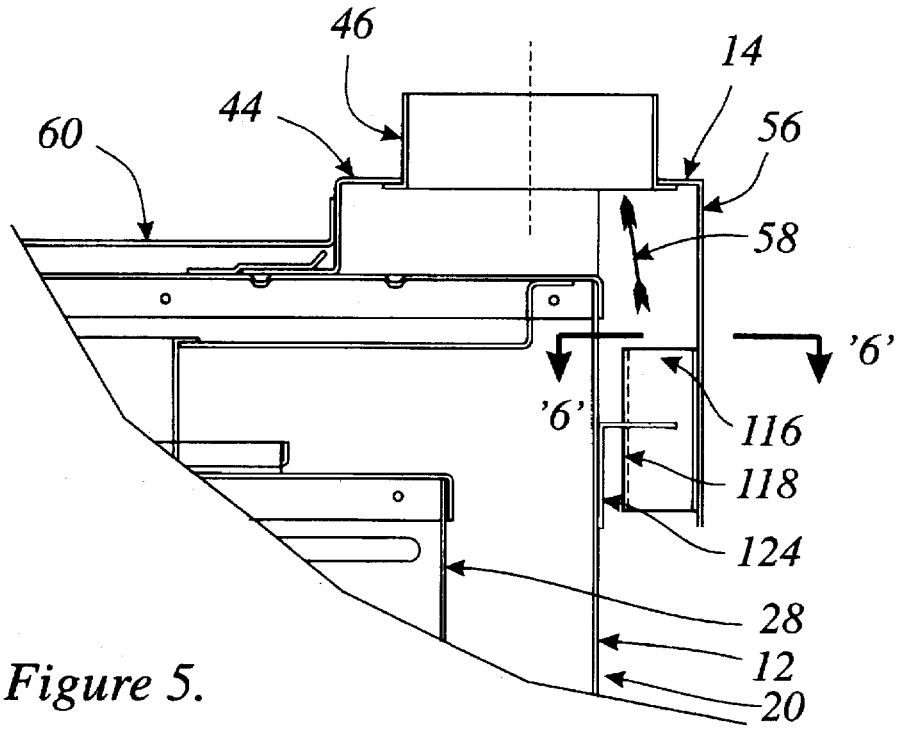
Figure 5.
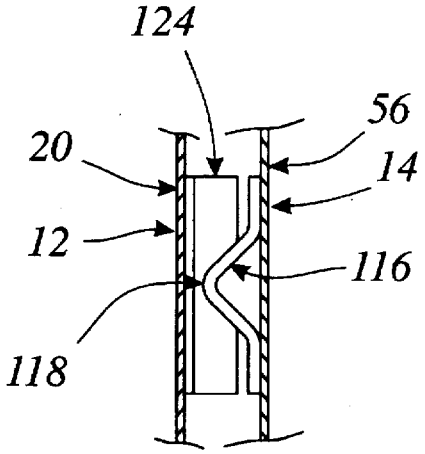
Figure 6(a).
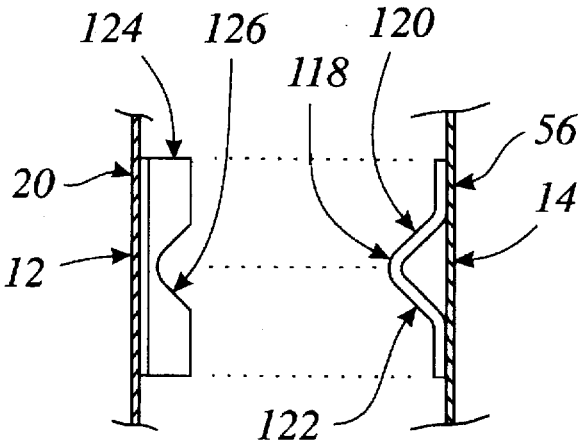
Figure 6(b).
Figure 6.

DRAFT HOOD LOCATING DEVICE FOR COMBUSTION APPARATUS

FIELD OF THE INVENTION

This invention relates generally to combustion apparatus requiring mating installation of a draft hood to a casing, and to a device for locating a draft hood relative to a combustion apparatus. In particular it relates to devices for locating a draft hood with respect to the upper and rear portions of a fireplace insert, such as a gas fireplace insert, to facilitate installation of such units in constricted spaces.

BACKGROUND ART

Combustion apparatus, such as wood stoves, wood fireplaces, coal fires, wall furnaces and gas fireplaces, are often installed in enclosures of limited, close fitting size. Installation usually begins with the introduction of a flue liner, or vent duct down a chimney passage of some type. An adapter, or draft hood, is then connected to the lower end of the duct. Initially the draft hood may hang from the ducting. A fireplace insert is next placed in the enclosure and, most often, slid rearwardly to engage the draft hood. The two are then linked, usually with fasteners, in a chosen location for conducting flue gases from the combustion apparatus to the liner.

The attachment of the draft hood to the combustion apparatus is frequently challenging. The size of enclosure into which a given insert may be installed is limited by the access space required to fix the adapter/draft hood to the combustion apparatus. In many cases the space available for fitting the draft hood to the combustion apparatus is very limited, sometimes as little as one inch (25 mm) vertical clearance, and the installer has very little space to see, let alone to work with tools.

In older types of fireplace, and in wood or coal fires, the flue hood or adapter was often sealed to the flue of the combustion apparatus. The exhaust temperatures of newer, gas fireplace inserts are limited by regulation. Thus gas fireplace insert draft hoods commonly have a shroud, or skirt, such that the flow of hot, buoyant flue gases up the liner or chimney can entrain cool air from the room in which the device is located, or from an external source. The mixed temperature of the entrained air and the flue gases is then less than the permitted maximum.

All fireplaces carry some risk of reversed flow, perhaps due to adverse weather conditions, which causes gases to flow down the chimney rather than up, with consequent safety hazards. Many fireplaces are now fitted with an updraft detection device, most commonly a spill tube, which allows a person to determine if there is proper draft. Further, there is a risk of the chimney being obstructed, as for example by a bird's nest. Many gas fireplace inserts are now required to have a manually reset flue over-temperature sensor, over-temperature often being an indicator of an obstructed passage. As this sensor is commonly located at the rear of the combustion apparatus adjacent the draft hood, reset access is generally correspondingly poor.

A number of attempts have been made to address the flue installation problem. One such attempt is shown in U.S. Pat. No. 4,924,850, issued May 15, 1990 to Rieger. In it a firebox top panel is provided with two longitudinal slides for guiding and retaining the sides of a plate, that plate having a flue stub protruding upwardly therefrom for connection to ducting. The plate has a rearward depending flange for catching on the rear edge of the firebox, and a forward, upturned flange for mating with an upturned front flange of the firebox. The opposed slides of Rieger are similar to the Adjustable Flue Adapter shown in U.S. Pat. No. 975,703 issued to McDonald on Nov. 15, 1910. An installer must start the plate into the slides before pushing the firebox rearwardly into the enclosure. The slides show a very long run-in, roughly equal to the depth of the unit. As fireboxes may have a considerable weight, and may neither slide as easily, nor in as straight a line as might be wished, a device with a relatively short run-in may be preferable. Canadian patent application 2,150,962 of Duong, filed Jun. 5, 1995 incorporates two opposed slides in the manner of McDonald and Rieger, but for a pair of openings for installing a flue liner to a direct vent fireplace.

U.S. Pat. No. 5,299,558 to Binzer, issued Apr. 5, 1994 shows a flue liner termination having a downwardly extending lip which engages a flue aperture in the firebox to control lateral position. A bracket is mounted on the rear face of the firebox and has a flange extending forwardly above the top panel. A slider assembly is mounted forward of the aperture. On installation the firebox is pushed into the enclosure far enough so that the rearward edge of the adapter may be drawn forward of the bracket flange, moved downwardly to introduce the lip into the flue opening, and then slid rearwardly under the flange. The slider is then closed over the forward edge of the adapter, trapping it against the bracket.

U.S. Pat. No. 5,377,666 to Whitehouse, issued Jan. 3, 1995 addresses the same problem as Rieger with a top plate that pivots about an engagement means at the rear of the firebox and is held down by a second fastening means near the front of the firebox. Two of the variations shown require that a tongue or hook be inserted in a slot before the adapter is pivoted to lie along the firebox top. These units again require that the adapter be movable sufficiently far forward relative to the firebox that the tongue can be moved rearwardly to engage the slot. The third variation shows an adapter with a depending, forwardly and downwardly extending hook-like member for introduction into a slot on the rear face of the firebox. As this hook-like member is at an angle, the plate must either be tilted to introduce the hook more or less horizontally in the slot, or there must be both vertical and horizontal relative motion of the firebox during installation to feed the angled hook into the slot. In all three cases the adapter is to be pivotable about the rear attachment, requiring vertical space in which to pivot.

U.S. Pat. No. 5,419,307 to Linkletter et al., issued May 30, 1995 shows a firebox having a top panel which extends rearwardly past the rear panel of the firebox, leaving a lip. The draft hood is provided with a downwardly hooked rear edge which catches on the lip as the firebox is slid rearwardly with respect to the draft hood. Three clips are located on the top panel of the firebox for retaining the body of the draft hood closely against the firebox. One clip may act as a forward stop while the two others are angled to fix the lateral horizontal position of the draft hood relative to the top panel. Metal straps extend forwardly to engage a forward portion of the firebox and complete the mounting at attachment points that are accessible once the unit has been slid substantially into place. If the draft hood is initially laterally mis-aligned it appears that it must slide along at least one clip and across the top panel of the draft hood as it is being jammed into that clip by the force is tending to pull the hood forward relative to the firebox.

There is, therefore, a need for an improved device for locating a draft hood relative to a combustion apparatus, such as a gas operated fireplace assembly.

SUMMARY OF THE INVENTION

In the present invention one finds a draft hood locating device for locating a draft hood in relation to a combustion apparatus, that combustion apparatus having a top panel and a rearward wall, wherein the device comprises a first member and a second member; the first member is located with the rearward wall, and the second member is located with the draft hood; the first member is engageable with the second member on rearward sliding motion of the combustion apparatus top panel relative to the draft hood; and at least one of the first member and the second member has lateral self-aligning means whereby engagement of the first and second members facilitates lateral positioning of the flue hood relative to the combustion apparatus. In a further aspect of the invention at least one of the first and second members includes a vertical restraint, or, in another embodiment of the invention, the apparatus includes a third member and a fourth member; the third member is located with the rearward, the fourth member is located with the draft hood, the third member is engageable with the fourth member on rearward sliding motion of the top panel relative to the draft hood; and at least one of the third member and the fourth member has vertical self-aligning means whereby engagement of the third and fourth members facilitates vertical restraint of the flue hood relative to the top panel of the combustion apparatus.

In a further aspect of the invention the draft hood locating device includes at least one forwardly extending member attached to the draft hood, that forwardly extending member being fastenable to the combustion apparatus on rearward sliding motion of the top panel relative to the draft hood.

In yet a further aspect of the invention the first member is a portion of an updraft detection device, such as a portion of a spill tube formed from a circular pipe, and having a substantially vertically oriented longitudinal axis. The spill tube itself may be retained by a bracket extending rearwardly from the rear wall, the bracket having a vertical restraint means, and the draft hood may be provided with a member for engaging the vertical restraint means to facilitate vertical location of the draft hood relative to the combustion apparatus.

In still another aspect of the invention one finds a combustion assembly comprising a casing containing a combustion chamber, the casing having a rear wall, side walls, and a top panel; the combustion assembly having a flue for carrying combustion products from the combustion chamber and out of the casing; a detachable draft hood for connection to the casing to transport combustion products from the flue to a vent; the rear wall provided with a first member for locating the draft hood relative to the casing; the draft hood provided with a second member for engagement of the first member on rearwardly sliding motion of the casing relative to the draft hood, and at least one of the first and second members having a lateral self-alignment means whereby engagement of the first and second members facilitates lateral positioning of the draft hood relative to the casing.

BRIEF DESCRIPTION OF DRAWINGS

FIG. 3*a* shows a partially sectioned top vie of the draft hood of FIG. 2. FIG. 3*b* shows a front view of the draft hood of FIG. 2.

FIGS. 4*a*, 4*b*, 4*c*, and 4*d*, show, respectively, a development view and side, front, and top views of a fitting for the draft hood of FIGS. 3*a* and 3*b*.

FIG. 5 is a partial cross sectional view similar to that of FIG. 2 showing a detail view of a mutually engaging bracket and fitting of an alternative embodiment of the invention of FIG. 1.

FIG. 6*a* shows a top view of the bracket and fitting of FIG. 5 in engagement, taken on '6'—'6' indicated in FIG. 5. FIG. 6*b* is similar view showing the bracket and fitting of FIG. 5 in a disengaged position.

BEST MODE FOR CARRYING OUT THE INVENTION

Figure 1:
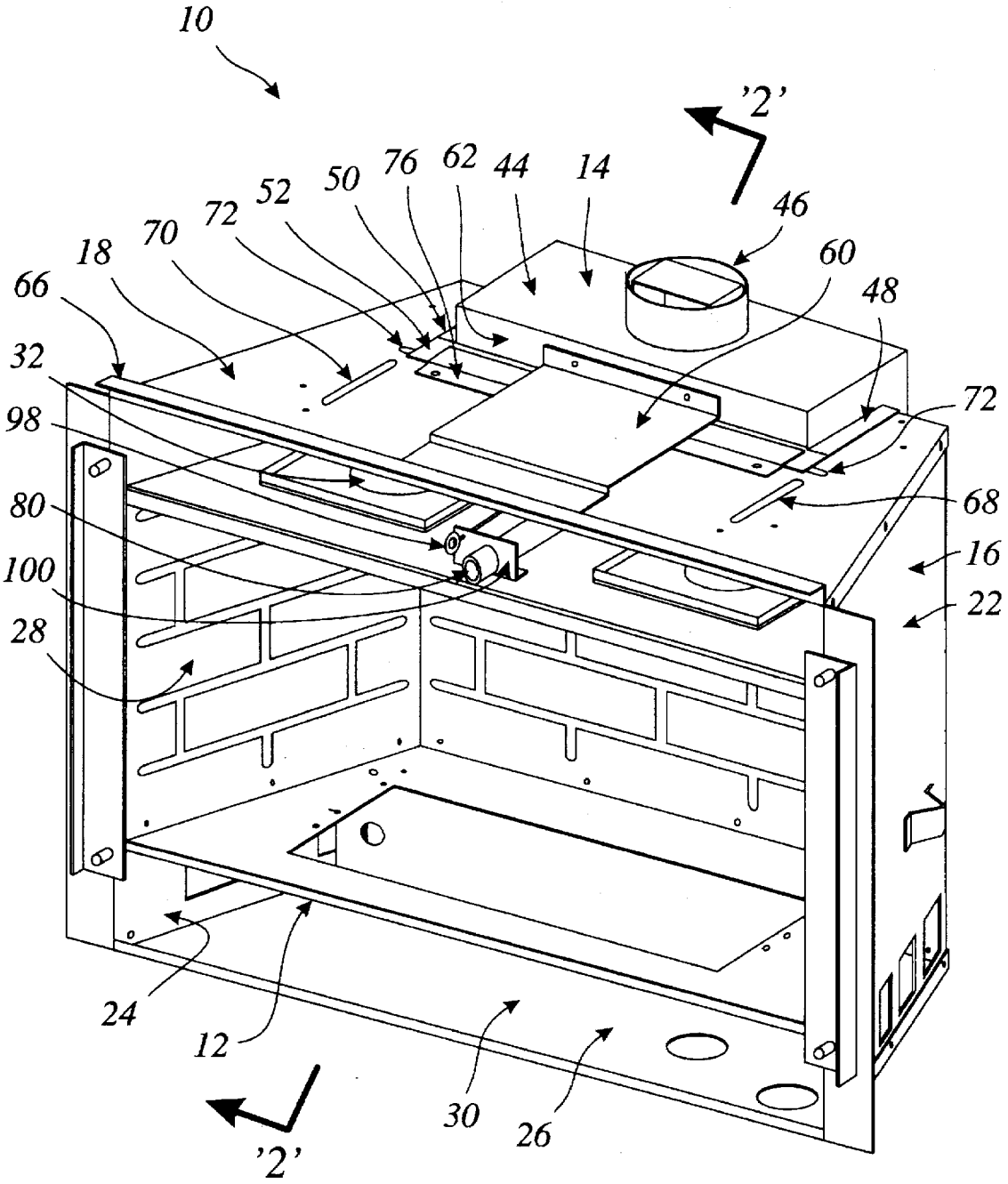
FIG. 1 is a general arrangement view of a fireplace assembly incorporating an embodiment of the present invention.

In the description which follows, like parts are marked throughout the specification and the drawings with the same respective reference numerals. The drawings are not necessarily to scale and in some instances proportions may have been exaggerated in order more clearly to depict certain features of the invention.

Figure 2:
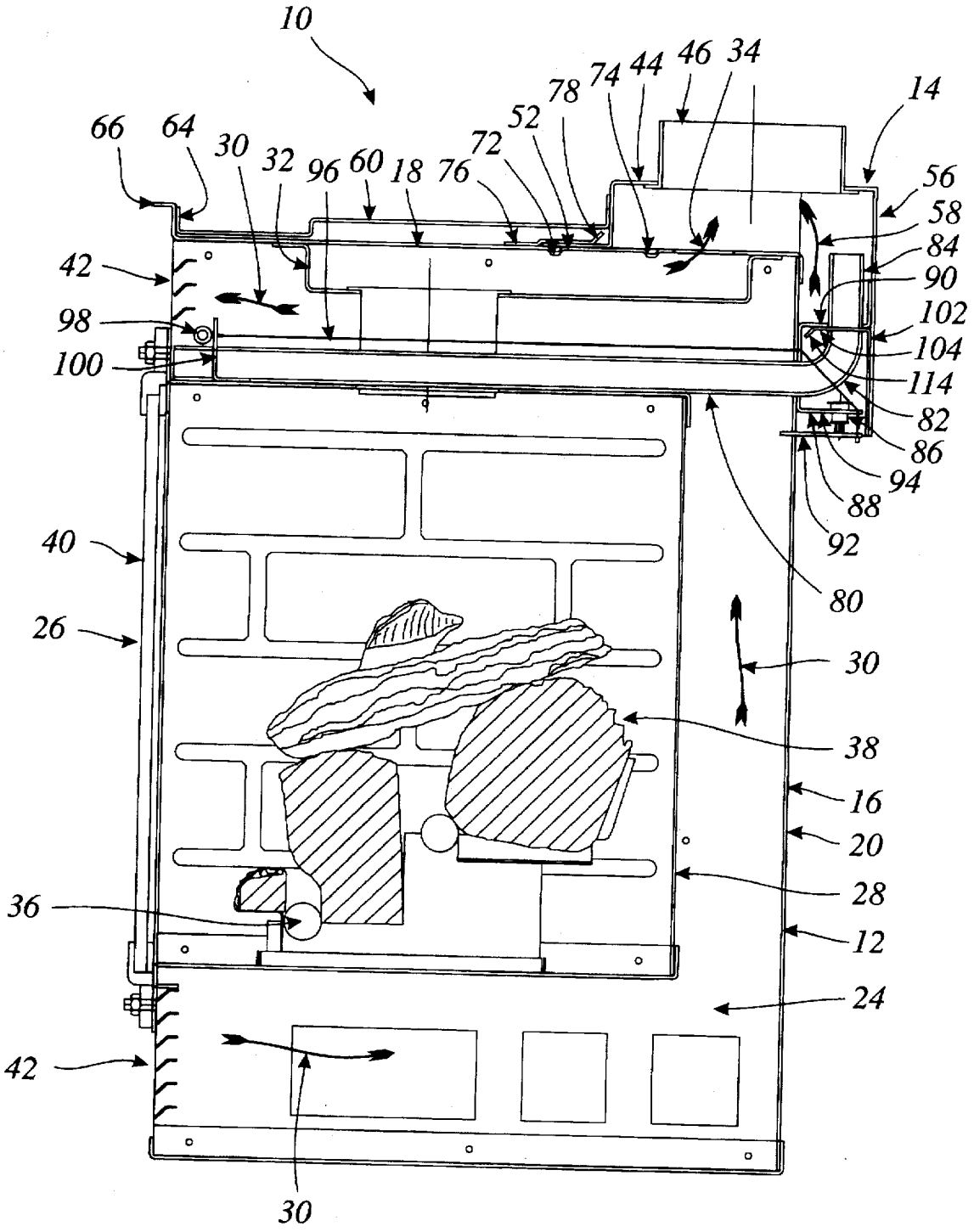
FIG. 2 is a cross-sectional view taken on section '2—2' indicated in FIG. 1, showing details of the mounting of a draft hood and casing of the fireplace assembly of FIG. 1.

Referring to FIGS. 1 and 2, a fireplace assembly is shown generally as 10. It comprises a combustion apparatus in the nature of a gas fireplace 12, and a draft hood 14 designed to mate with fireplace 12. It should be noted that other combustion devices, such as a traditional wood fire, coal fire, or wood stove could be substituted for gas fireplace 12 without altering the essence of the present invention.

Fireplace 12 comprises a casing 16, that casing having a top panel 18, a rear wall 20, left and right hand walls 22 and 24 respectively, and a front opening 26. Although casing 16 may form the walls of a combustion chamber directly, in the example shown a combustion chamber in the nature of a firebox 28 is shown suspended within casing 16 to leave space for air to circulate about the firebox through an air-wipe, indicated generally as 30. The firebox gives onto a flue assembly 32 which itself has ports 34 let through top panel 18 by which means combustion products may exit firebox 28. A gas burner 36 is located within firebox 28, and may be accompanied by an aesthetically pleasing arrangement of simulated wood logs 38, as shown only in FIG. 2. For the purposes of the present invention this burner could be a traditional wood or coal fire or liquid fuel burner. A window 40 is located across the front of firebox 28 above a grille 42 by which means air may be drawn into firebox 28 for combustion. Although the firebox is shown drawing combustion air from the room in which it is placed, a different source of combustion air could be employed.

Draft hood 14 has a body, indicated generally as 44, sufficiently extensive to overlie ports 34 when draft hood 14 is located in position on casing 16. A stub flue, or collar 46 surmounts body 44, and is of a diameter suitable for connection to a flue liner, not shown, by conventional means. A set of peripheral flanges, being left hand flange 48, right hand flange 50, and forward flange 52 extend away from body 44 in a plane substantially parallel to the plane of top panel 18 such that they may lie flat with respect thereto. An U-shaped gasket 54 is shown in FIG. 3 affixed to the lower faces of flanges 48, 50, and 52 for contacting top panel 18. As installed, body 44 extends rearwardly of rear wall 20, and terminates in a depending skirt 56 which hangs down behind, and in spaced parallel relationship from, rear wall 20, leaving therebetween an air passageway, generally indicated as 58. Finally, draft hood 14 comprises an handle, generally indicated as 60. It is mounted to a front face 62 of body 44 and extends forwardly thereof to terminate at its foremost end in an attachment means in the nature of an handle flange 64 to be fastened by known means to a raised top panel front flange 66.

Flexure of top panel 18 is resisted by four downwardly stamped, dimples, or ribs, being left and right hand foreand-aft ribs 68 and 70, and laterally extending front and rear transverse ribs 72 and 74. A top panel stop 76 is mounted to top panel 18 immediately rearward of transverse rib 72. Stop 76 acts as a catch or retainer for forward flange 52 to hold the forward portion of draft hood 14 next to casing 16. In the event that draft hood 14 is suspended slightly above the height of top panel 18 before installation, an upturned curved or chamfered lip 78 may be provided to encourage forward flange 52 and hence the forward part of body 44, to sit snug against top panel 18.

As is best shown in the cross-section of FIG. 2, an updraft detection device in the nature of a spill tube 80 is mounted to casing 16. It is disposed to have a forward end terminating near frontal opening 26, to run rearwardly along air wipe 30, to traverse rear wall 20, and to give onto air passageway 58. In the preferred embodiment spill tube 80 has an upturned 90 degree elbow 82 located rearwardly of rear wall 20, and a short portion of substantially straight pipe 84 having a longitudinal axis oriented substantially vertically such that the open end of spill tube 80 faces upward. An over-temperature sensor 86 is mounted to rear wall 20 by means of an over-temperature sensor bracket 88, which also has a rearwardly extending leg 90 having an aperture to fit about pipe 84, maintaining its vertical orientation.

Over-temperature sensor 86 is a manual reset sensor. To permit manual reset with neither a complicated mechanism nor complicated control circuitry, a remote reset assembly is provided which includes a hinged flapper 92 which depends from rear wall 20 beneath sensor 86, itself mounted to shelf 94 of bracket 88; and a cable, or wire, such as lanyard 96 connected to the distal end of flapper 92, which lanyard runs through an eyelet of shelf 94, continues through an eyelet in rear wall 20, and is strung substantially co-axially with spill tube 80, terminating at a pull ring 98 mounted through a rigging bracket 100 near front opening 26.

As also shown in FIGS. 2 and 4, a draft hood alignment fitting 102 is mounted on the inner, or forward, face of skirt 56. A bifurcated leg 104 of fitting 102 extends in a substantially horizontal plane forwardly of skirt 56, and has a taper sided relief 106 let into leg 104 from its distal edge to leave two toes 108 and 110. Each of toes 108 and 110 has a downwardly chamfered tip 112 and 114, for location at a height suitable for sliding engagement of the underside of leg 90 of bracket 88. As will be more fully described below, the interaction of pipe 84, bracket 88 and fitting 102 provides a draft hood locating apparatus for facilitating the lateral, and if desired, vertical placement of draft hood 14 relative to casing 16 of the combustion device.

A second embodiment of the present invention is illustrated in FIGS. 5, 6*a* and 6*b*. This embodiment is applicable where no updraft detection device is present, or for which the mounting previously described is unsuitable. In that case bracket 88 may be replaced by an angle bracket 116 having a substantially vertically oriented spine 118, and a pair of legs 120 and 122. Bracket 116 is mounted to draft hood 14 with spine 118 outermost therefrom and with legs 120 and 122 oriented at respective oblique angles to rear wall 20. Similarly fitting 102 may be replaced by a fitting 124 having a taper-sided relief 126 suited for engagement of legs 120 and 122. A compound bracket having one or more tapered surfaces for controlling both vertical and lateral placement may be formed, or two sets of fittings may be provided, one with vertical orientation, and the other with lateral orientation to achieve the same result. It will also be realized that a self-aligning tendency can be achieved even if only one of the engaging parts is tapered. For example, two parallel, vertically oriented pins could receive spine 118 between them, whether tapered or not. As noted, the receiving part need not have a continuous surface.

In the case of the alternative embodiment of FIGS. 5, 6*a* and 6*b*, it will be apparent that the function of the bracket and fitting pair will be unchanged by mounting bracket 116 to skirt 56 and mounting fitting 122 to rear wall 20. Similarly, although straight sided features are shown, suitably rounded surfaces, like those of pipe 84, may be used. Further, male and female features may be formed integrally in one or other of rear wall 20 or skirt 56 without need for fastenings.

The operation of the present invention will now be described. As with conventional fireplace inserts and flue liners, the first step is to install a vent duct in the chimney, or chimney-like passage, and to connect that liner or vent duct to collar 46 of draft hood 14, which will then hang in the fireplace enclosure at some height with handle 60 extending forwardly in reach of the installer. It is preferred that body 44 hang, unsupported, at a level marginally below that of top panel 18 such that when the installer begins to push combustion device 12 rearwardly under handle 60 body 44 can rest gently upon, and slide easily across, top panel 18. The installer need not be able to see the top of rear wall 20 and need not precisely align casing 16 with draft hood 14, provided the misalignment is less than the allowance of the width of tips 112 and 114. As casing 16 is pushed rearwardly the action of tapered relief 106 acting on the rounded surface of pipe 84 will cause self-alignment of the draft hood relative to the casing, before, and without, front flange 52 becoming jammed against stop 76. In the event that draft hood 44 does not hang low enough to rest upon top panel 18, but is close to it, the chamfer of tips 112 and 114 is such that they will feed under leg 90, and the chamfer of stop 76 is such that forward flange 52 will be pulled down, causing draft hood 44 to sit against top panel 18 as desired. This result is achieved without the need for the installer to be able to see a slot into which to insert a tongue, and without needing first to move the flue hood forward of a rear attachment, and then, second, to move it rearward to engage the combustion device. Further, the present invention can be installed entirely by sliding the combustion device rearwardly, without the requirement of vertical space in which to pivot the draft hood downward, and without a long run-in.

In operation the buoyant, hot flue gasses rising in the chimney entrain cold air from behind the casing, causing that air to flow through air passageway 58. Since it is desirable for best function of the sensors, spill tube 80 and over temperature sensor 86, that they be located in or near passage 58, it is advantageous additionally to use them, or their brackets, for the purpose of maintaining position of the two adjacent assemblies which define the passageway 58 itself.

The present invention thus provides a draft hood locating device for locating draft hood 14 in relation to a combustion apparatus, fireplace 12, itself having top panel 18 and rearward wall 20, wherein that device includes a first member, pipe 84, and a second member fitting 102, the first member is located with rearward wall 20, and the second member is located with draft hood 14. The first member is engageable with the second member on rearward sliding motion of top panel 18 relative to the draft hood 14. The first and second members have lateral self-aligning means, being the interacting rounded profile of pipe 84 and tapered sided relief 106, whereby engagement of the first and second members facilitates lateral positioning of flue hood 14 relative to fireplace 12. The first and second members of the preferred embodiment also present a vertical restraint which extends rearwardly from rear wall 20 in the form of leg 90 of bracket 88 and its interaction with toes 108 and 110 of fitting 102. Several possible alternatives are noted above, including separate third and fourth members provided to facilitate vertical restraint of draft hood 14 on rearward sliding motion of top panel 18 relative thereto. Furthermore, in the preferred embodiment the first member, pipe 84 is a portion of an updraft detection device, specifically spill tube 80, itself formed from standard circular pipe, and having a substantially vertically oriented longitudinal axis. Pipe 84 is restrained by bracket 88.

The preferred embodiment described also includes a forwardly extending member, handle 60 attached to draft hood 14, fastenable to fireplace 12 at a location forward of the draft hood, top panel front flange 66. Further, forward flange 52 extends forwardly from draft hood 14, and is disposed in substantially parallel planar relationship to top panel 18. Stop 76 is attached to top panel 18 to engage flange 52.

A combustion assembly in the nature of fireplace assembly 10 comprises casing 16 containing a combustion chamber, firebox 28, and having frontal opening 26 to permit observation of a fire contained therewithin. Casing 16 includes rear wall 20, side walls 22 and 24, and a top panel 18. Fireplace assembly 10 has a flue and heat exchanger, indicated generally as flue assembly 32, for carrying combustion products from the combustion chamber and out of casing 16. Detachable draft hood 14 is designed for connection to a vent and for connection to casing 16 to transport combustion products from flue assembly 32 to the vent. Rear wall 20 is provided with a first member, pipe 84 for locating draft hood 14 relative to casing 16. Draft hood 14 is also provided with a second member, fitting 102 for engagement of the first member on rearwardly sliding motion of casing 16 relative to draft hood 14, and the first and second members have a lateral self-alignment means, as described above, whereby engagement of the first and second members facilitates lateral positioning of draft hood 14 relative to casing 16.

In the alternative embodiment of FIGS. 5 *6a* and *6b*, the first member is a first angle bracket 116 having a substantially vertically oriented spine 118, and legs 120 and 122 extending, on installation, away from spine 118 at respective angles oblique to rear wall 20; and the other of the first and second members is a second angle bracket, fitting 124 having a relief 126 for receiving the first member.

Various embodiments of the invention have now been described in detail. Since changes in and/or additions to the above-described best mode may be made without departing from the nature, spirit or scope of the invention, the invention is not to be limited to said details, but only by the appended claims and their equivalents.

We claim:

1. A draft hood locating device for locating a draft hood in relation to a combustion apparatus, the combustion apparatus having a top panel and a rear wall, said device comprising a first member located on the rear wall and a second member located on the draft hood, said first member being engageable with said second member on rearward sliding motion of the top panel relative to the draft hood, at least one of said first member and said second member having means for laterally positioning the draft hood relative to the top panel as said first and second members are engaged, whereby the draft hood is located in relation to the combustion apparatus.

2. The draft hood locating device of claim 1 wherein at least one of said first and second members further comprises a vertical restraint.

3. The draft hood locating device of claim 1 further comprising:

a third member and a fourth member;

said third member being located on the rear wall;

said fourth member being located on the draft hood;

said third member being engageable with said fourth member on rearward sliding motion of the top panel relative to the draft hood; and at least one of said third member and said fourth member having means for vertically restraining the draft hood relative to the combustion apparatus when said third and fourth members are engaged.

4. The draft hood locating device of claim 1 wherein said device includes at least one forwardly extending member located on the draft hood, said forwardly extending member being fastenable to the combustion apparatus at a location forward of the draft hood.

5. The draft hood locating device of claim 4 further comprising a flange extending forwardly from the draft hood, said flange being disposed for substantially planar contact with the top panel, said device further comprising a stop attached to the top panel to engage said flange on a rearward sliding motion of the top panel relative to the draft hood.

6. The draft hood locating device of claim 1 wherein said first member is a portion of an updraft detection device.

7. The draft hood locating device of claim 6 wherein said updraft detection device is a spill tube, and said first member is a portion of the spill tube, said portion being formed from a circular pipe, and having a substantially vertically oriented longitudinal axis.

8. The draft hood locating device of claim 7 wherein said second member includes a tapered relief for receiving said portion of the spill tube when said first and second members are engaged.

9. The draft hood locating device of claim 6 wherein:

said device further includes a bracket extending rearwardly from the rear wall, said bracket having a vertical restraint, said updraft detection device portion being retained by said bracket, and the draft hood having means for engaging said vertical restraint to facilitate vertical location of the draft hood relative to the combustion apparatus.

10. The draft hood locating device of claim 9 wherein the updraft detection device is a spill tube, said first member is a portion thereof formed from a circular pipe, and said first member has a substantially vertically oriented longitudinal axis.

11. A combustion assembly comprising:

a casing containing a combustion chamber, said casing have a rear wall, side walls, and a top panel;

a flue for carrying combustion products from said combustion chamber and out of said casing;

a detachable draft hood located on said casing to transport combustion products from said flue to an external vent;

said rear wall having a first member for locating said draft hood relative to said casing;

said draft hood having a second member engageable with said first member on rearward sliding motion of said casing relative to said draft hood; and at least one of said first and second members having means bilaterally positioning said draft hood relative to said casing as said first and second members are engaged, whereby lateral positioning of said draft hood relative to said casing is facilitated.

12. The combustion assembly of claim 11 wherein said combustion assembly is a fireplace assembly, and said casing has a frontal opening to permit observation of a fire contained within said combustion chamber.

13. The fireplace assembly of claim 12 wherein:

at least one of said first and second members has a tapered surface and engagement of said tapered surface by the other of said first and second members causes a lateral component of displacement of said draft hood relative to said casing.

14. The fireplace assembly of claim 12 wherein one of said first and second members is a first angle bracket having a substantially vertically oriented spine, said bracket having legs extending away from said spine at respective oblique angles, the other of said first and second members being a second angle bracket having a relief for receiving said first member.

15. The fireplace assembly of claim 12 wherein one of said first and second members has an at least partially rounded surface and the other of said first and second members has a tapered relief, said rounded surface having a substantially vertical longitudinal axis, whereby engagement of said first and second members causes lateral motion of said draft hood relative to said casing.

16. The fireplace assembly of claim 12 wherein said assembly includes an updraft detection device mounted to said casing and said first member is a portion of said updraft detection device.

17. The fireplace assembly of claim 16 wherein said updraft detection device is a spill tube, and said first member is a portion of said spill tube formed from a circular pipe, and having a substantially vertically oriented longitudinal axis.

18. The fireplace assembly of claim 17 wherein said second member includes a tapered relief for receiving said portion of said spill tube when said first and second members are engaged.

19. The fireplace assembly of claim 16 wherein said fireplace assembly further includes a bracket extending rearwardly from said rear wall, said updraft detection device portion being retained by said bracket, said bracket having restraint means for vertically restraining said draft hood relative to said top panel; and said draft hood includes means for engaging said restraint means to facilitate vertical location of said draft hood relative to said fireplace assembly.

20. The fireplace assembly of claim 19 wherein said updraft detection device is a spill tube, and said first member is a portion of said spill tube, said portion being formed from a circular pipe and having a substantially vertically oriented longitudinal axis.

21. The fireplace assembly of claim 16 wherein said assembly further comprises:

a manual reset over-temperature sensor mounted with said first member, said sensor being provided with a remote reset assembly;

said remote reset assembly being linked to said sensor and extending therefrom and terminating adjacent said frontal opening.

22. The fireplace assembly of claim 21 wherein:

said remote reset assembly comprises a lanyard rigged substantially co-axially with said updraft detection device.

* * * * *